US005304315A

United States Patent [19]

Stover

[11] Patent Number: 5,304,315

[45] Date of Patent: Apr. 19, 1994

[54] PREVENTION OF GEL FORMATION IN TWO-CYCLE OILS

[75] Inventor: William H. Stover, Sarnia Ontario, Canada

[73] Assignee: Exxon Chemical Patents Inc., Linden, N.J.

[21] Appl. No.: 869,284

[22] Filed: Apr. 15, 1992

[51] Int. Cl.[5] ..... C10M 145/16; C10M 149/00

[52] U.S. Cl. ..... 252/51.5 A; 252/56 D; 252/77; 252/79

[58] Field of Search ..... 252/56 D, 51.5 A

[56] References Cited

U.S. PATENT DOCUMENTS

| | | | |
|---|---|---|---|
| 2,278,445 | 4/1942 | Hull | 196/10 |
| 2,301,052 | 11/1942 | Kirn et al. | 196/10 |
| 2,318,719 | 5/1943 | Schneider et al. | 196/10 |
| 2,329,714 | 9/1943 | Grasshof | 196/10 |
| 2,422,443 | 6/1947 | Smith | 196/78 |
| 2,568,876 | 9/1951 | White et al. | 106/14 |
| 2,825,717 | 3/1958 | Cashman et al. | 252/56 D |
| 2,936,300 | 5/1960 | Tutwiler et al. | 252/56 D |
| 3,087,936 | 4/1963 | Le Suer | 260/326.3 |
| 3,110,673 | 11/1963 | Benoit | 252/51.5 |
| 3,124,552 | 3/1964 | Tirtiaux et al. | 252/56 D |
| 3,136,743 | 6/1964 | Conway et al. | 252/56 D |
| 3,143,513 | 8/1964 | Day et al. | 252/56 R |
| 3,163,603 | 12/1964 | Le Suer | 252/33.6 |
| 3,172,892 | 3/1965 | Le Suer et al. | 260/326.5 |
| 3,216,936 | 11/1965 | Le Suer | 252/32.7 |
| 3,219,666 | 11/1965 | Norman et al. | 260/268 |
| 3,272,746 | 9/1966 | Le Suer et al. | 252/47.5 |
| 3,306,907 | 2/1967 | McNinch et al. | 260/326.3 |
| 3,340,281 | 9/1967 | Brannen, Jr. | 260/404.5 |
| 3,346,354 | 10/1967 | Kautsky et al. | 44/63 |
| 4,200,545 | 4/1980 | Clason et al. | 252/33.4 |
| 4,234,435 | 11/1980 | Meinhardt et al. | 252/51.5 A |
| 4,663,063 | 5/1987 | Davis | 252/51.5 R |
| 4,705,643 | 11/1987 | Nemo | 252/51.5 A |
| 4,708,809 | 11/1987 | Davis | 252/33.4 |
| 4,772,674 | 9/1988 | Shih et al. | 252/56 D |
| 4,780,111 | 10/1988 | Dorer et al. | 44/71 |
| 4,839,074 | 6/1989 | Rossi et al. | 252/56 D |

OTHER PUBLICATIONS

Ethylene Amines in Encyclopedia of Chemical Technology Kirk-Othmer, vol. 5, pp. 898-905, Interscience Publishers, N.Y. (1950).

*Primary Examiner*—Ellen M. McAvoy
*Attorney, Agent, or Firm*—V. T. White

[57] ABSTRACT

A two-cycle oil dispersant additive which substantially avoids the formation of gelled agglomerates at low temperatures and which correspondingly provides effective engine cleanliness, detergency, lubricity and wear inhibition comprising: a dispersant (I) which is a nitrogen-containing compound prepared by reacting (A) at least one polyalkylene polyamine and (B) at least one monocarboxylic acid acylating agent, and optionally (C) at least one high molecular weight substituted carboxylic acid acylating agent; and (II) at least one wax crystal modifier which is a "comb" type copolymer of a mono or dialkyl ester of a monoethylenically unsaturated $C_4$ to $C_8$ mono or dicarboxylic acid or anhydride wherein the number of carbon atoms in the n-alkyl groups is 14.

22 Claims, No Drawings

PREVENTION OF GEL FORMATION IN TWO-CYCLE OILS

BACKGROUND OF THE INVENTION

The invention relates to an additive composition and concentrate for two-cycle oils. The additive, when incorporated into two-cycle oils, produces a dispersant additive composition which will provide satisfactory engine cleanliness and importantly will render the oil stable after being subjected to low temperatures. The additive compositions of the invention substantially delays or avoids the formation of gelled agglomerates which in previous prior art products have become a concern with respect to engine performance.

Two-cycle (two-stroke) internal combustion engines, including rotary engines are found in power lawn mowers and other power-operated gardening equipment, power chain saws, pumps, electrical generators, marine outboard engines, snowmobiles, motorcycles, and the like. Two-cycle engines employed as such are operated by mixing the fuel and the two-cycle oil in prescribed proportions. The two-cycle oil additive of the instant invention is designed for use in most types of two-cycle engines and particularly in water-cooled marine outboard engines.

Two-cycle engines are lubricated by mixing the lubricant with the fuel for the engine. The mixture of fuel and lubricant passes through the crankcase of a two-cycle engine, where it lubricates the moving parts of the engine, and then flows through intake ports into the combustion chamber of the engine where the mixture of the fuel and lubricant is burned. The combustion products are vented from the combustion chambers through exhausts ports. As a consequence, a satisfactory lubricant for a two-cycle engine must not only provide adequate lubrication for moving engines parts but also must be able to pass into the combustion chamber leaving no objectional deposits in the intake ports; must burn cleanly to avoid fouling the combustion chamber and spark plug with undesirable deposits; control varnish and sludge formation which leads to ring sticking and in turn to failure of the sealing function of piston rings; and must not result in plugging of the exhaust ports.

The increasing severity of the conditions under which two-cycle engines operate, has led to increasing demands for oils to adequately lubricate such engines. Alleviation of the problems has been through the provision of more effective additives for two-cycle engine oils and oil fuel combinations.

It is known to use acylated nitrogen-containing compounds as dispersant in two-cycle oil lubricants to prevent the deposition of solid materials on engine surfaces in contact with the lubricating composition. Such acylated nitrogen-containing compounds, as for instance the reaction product of isostearic acid and a polyamine, are disclosed in U.S. Pat. Nos. 3,110,673 and 4,705,643. These products are, however, susceptible to forming gel like agglomerates called "fish-eyes", when subjected to low temperatures as experienced in storage. The matrix for the gels are thought to be compounds formed during synthesis. The gel can be observed by inverting a glass vial of dispersant in oil and watching for the globules or agglomerates which adhere to the glass surface. Once formed, the gel is stable at room temperature and can cause blocking of the filters of the two-cycle engines in addition to rendering the oil lumpy and aesthetically displeasing for marketing purposes.

U.S. Pat. No. 3,110,673 mentioned above discloses a lubricant composition containing a pour point depressant and ashless dispersant. The ashless dispersant is described as the reaction product of a polyalkylene amine and a mixed, branched and straight chain acid.

U.S. Pat. No. 4,705,643, also mentioned above, described an ashless lubricating two-cycle oil-additive comprised of the condensation reaction product of a branched isostearic acid and tetraethylene pentamine.

U.S. Pat. No. 2,568,876 discloses the use of organic nitrogen compounds as corrosion inhibiting compositions. The organic nitrogen compound disclosed are reaction products of monocarboxylic acids, and polyalkylene polyamines having one more nitrogen atom per molecule than there are alkylene groups in the molecule, which are further reacted with an alkenyl succinic acid anhydride. The ratio of alkenyl succinic acid to monocarboxylic acid disclosed is 1:1 to 4:1 and the alkenyl radical carbon range disclosed preferably range from 8 to 18.

U.S. Pat. No. 3,216,936 discloses nitrogen-containing compositions derived from the acylation of alkylene amines and is used to stabilize metal phosphorodithioates antioxidant additives in lubricating compositions. The acylated amines of the patent are prepared by heating together an alkylene amine with an acidic mixture consisting of a hydrocarbon-substituted succinic acid and an aliphatic monocarboxylic acid. The equivalent amount of succinic acid to monocarboxylic acid disclosed range from 1:0.1 to about 1:1.

U.S. Pat. Nos. 4,200,545; 4,708,809; 4,663,063; 4,708,809 and 4,780,111 all disclosed products derived from reacting first and second acylating agents comprising carboxylic acids or anhydrides with polyamines wherein the range of equivalence for the succinic acid agent to monocarboxylic acid ranges from 1:1 to 10:1.

Copending U.S. application U.S. Ser. No. 742,955, filed Aug. 9, 1991, incorporated herein by reference and U.S. Ser. No. 869,282, and U.S. Ser. No. 869,281 filed contemporaneously with the instant application all disclose compositions for two-cycle oils and especially two-cycle water-cooled outboard engines. U.S. copending application Ser. No. 742,955 discloses controlling gel formation in two-cycle oil with an additive comprising a reaction product of a monocarboxylic acid, a polyalkylene polyamine and a high molecular weight acylating agent. The application further disclosed additive compositions also containing a polyolefin and a pour point depressant flow improver.

The present invention is directed to an additive for two-cycle lubricating oils especially two-cycle oil additives for water-cooled outboard engines. The invention is further directed to an additive which is stable at low temperatures and which additionally provides good detergency, lubricity, antiwear and corrosion inhibition.

It is therefore an object of the invention to provide a low temperature stable two-cycle oil additive which will not form gels at low temperatures and which provide satisfactory engine cleanliness.

SUMMARY OF THE INVENTION

A two-cycle oil dispersant additive has been discovered which substantially avoids the formation of gelled agglomerates at low temperatures and which correspondingly provides effective engine cleanliness, detergency, lubricity and wear inhibition. It has been discovered that a two-cycle oil additive comprising: a dispersant (I) which is a nitrogen-containing compound prepared by reacting (A) at least one polyalkylene polyamine and (B) at least one monocarboxylic acid acylating agent, and optionally (C) at least one high molecular weight substituted carboxylic acid acylating agent; and (II) at least one wax crystal modifier which is a "comb" type copolymer of a mono or dialkyl ester of a monoethylenically unsaturated $C_4$ to $C_8$ mono or dicarboxylic acid or anhydride wherein the number of carbon atoms in the n-alkyl groups is 14. The dispersant of the invention comprise molecules containing oil soluble hydrocarbon moiety(ies) connected to polar moieties which are substantially comprised of tertiary amines, preferably imidazoline heterocycles, wherein the ratio of tertiary amine to total amine is above about 0.6:1 and preferably at least about 0.7:1. The additive remains stable to the formation of the gelled agglomerants, especially during prolong storage at low temperatures (0° C. or less).

The use of the two-cycle additive compositions of the instant invention avoids or reduces the formation of gel (or flock-possible gel precursors) at low temperature in addition to providing dispersancy which prevents the buildup of harmful deposits which reduce engine performance in two-cycle engines.

DETAILED DESCRIPTION OF THE INVENTION

Broadly stated, the invention is directed to a two-cycle oil lubricating oil additive and compositions and concentrates containing said two-cycle oil additives and to processes for using said two-cycle oil additives.

The two-cycle oil additives to the invention comprise (I) the reaction product of (A) at least a polyalkylene-polyamine and (B) at least one monocarboxylic acid acylating agent and optionally (C) at least one high molecular weight mono or polycarboxylic acid type acylating agent and (II) a wax crystal modifier which comprises a "comb" type copolymer of a mono or dialkyl ester of a monoethylenically unsaturated $C_4$ to $C_8$ mono or dicarboxylic acid or anhydride wherein the number of carbon atoms in the n-alkyl groups is 14. Throughout this specification and claims, any reference to carboxylic acids as acylating agent is intended to include the acid-producing derivatives such as anhydrides, esters, acyl halides, and mixtures thereof unless otherwise specifically stated.

The two-cycle engine oil compositions of the invention comprise a major amount of an oil of lubricating viscosity. Typically this viscosity is in the range of about 20 to about 50 cst at 40° C.

These oils of lubricating viscosity can be natural or synthetic oils. Mixtures of such oils are also often useful.

Natural oils include mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils.

Synthetic lubricating oils include hydrocarbon oils such as polymerized and interpolymerized olefins, alkylated diphenyl ethers and alkylated diphenyl sulfides and the derivatives, analogs and homologs thereof and the like.

Oils made by polymerizing olefins of less than 5 carbon atoms are typical synthetic polymer oils. Methods of preparing such polymer oils are well known to those skilled in the art as is shown by U.S. Pat. Nos. 2,278,445; 2,301,052; 2,318,719; 2,329,714; 2,345,574; and 2,422,443.

Alkylene oxide polymers (i.e., homopolymers, interpolymers, and derivatives thereof where the terminal hydroxyl groups have been modified by esterification, etherification, etc.) constitute a class of known synthetic lubricating oils for the purpose of this invention especially for use in combination with alkanol fuels. They are exemplified by the oils prepared through polymerization of ethylene oxide or propylene oxide, the alkyl and aryl ethers of these polyoxyalkylene polymers (e.g., methyl polypropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, octyl alcohol, dodecyl alcohol, tridecyl alcohol, 2-ethylhexyl alcohol, ethylene glycol, diethylene glycol monoether, propylene glycol, etc.). Specific examples of these esters include dioctyl adipate, di(2-ethylhexyl)sebacate, di-n-hexyl fumarate, dioctyl sebacate, diisoctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{18}$ monocarboxylic acids and polyols and polyol ethers such as neopentyl glycol, trimethylol propane, pentaerythritol, dipentaerythritol, tripentaerythritol, etc.

Unrefined, refined and rerefined oils, either natural or synthetic (as well as mixtures of two or more of any of these) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from primary distillation or an ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes similar to those used to obtain refined oils which have been already used in service. Such rerefined oils are also known as reclaimed or reprocessed oils and often are additionally processed by techniques directed to removal of spent additives and oil breakdown products.

I - The Dispersant

The reaction of the monocarboxylic acid and polyamine produces amide/imidazoline products. When the optional high molecular weight acylating agent (diacids of anhydrides thereof) is employed, imides are also formed.

A - Polyalkylenepolyamines

The polyalkene polyamines useful as a reactant may be generally characterized by the formula $$H_2N(-\underset{\underset{R^1}{|}}{R}NH)_nH$$

wherein R is a $C_2$ or $C_3$ alkylene radical or mixtures thereof; $R^1$ is H or an alkyl radical of from about 1 to about 16 carbon atoms and n is an integer of one or greater.

Preferably, n is an integer less than about 6, and the alkylene group R is ethylene or propylene. Non-limiting examples of the polyalkylenepolyamine reactants are ethylenediamine, diethylenetriamine; triethylenetetramine; tetra-ethylenepentamine; di-(methylethylene)triamine; hexa-propyleneheptamine; tri-(ethylethylene) tetramine; dipropylenetriamine; penta(1-methylpropylene)-hexamine; hexa-(1,1-dimethylethylene)-heptamine; tri-(1,2,2-trimethylethylene) tetramine; triamine; tetra-(1,3-dimethylpropylene)-pentamine; penta-(1,2-dimethyl-1-isopropylethylene) hexamine; penta-(1-methyl-2-benzylethylene)hexamine; tetra-(1-methyl-3-benzylpropylene)pentamine; tri-(1-methyl-1-phenyl-3-propylpropylene)tetramine; and tetra-(1-ethyl-2-benzylethylene)pentamine. The ethylene amines are especially useful. They are discussed in some detail under the heading "Ethylene Amines" in "Encyclopedia of Chemical Technology" Kirk and Othmer, Vol. 5, pages 898–905. Interscience Publishers, New York (1950). Such compounds are prepared most conveniently by the reaction of alkylene dihalide, e.g., ethylene dichloride, with ammonia or primary amines. This reaction results in the production of somewhat complex mixtures of alkylene amines including cyclic condensation products such as piperazine and N-alkyl substituted piperazines. These mixtures find use in the process of this invention.

B - Monocarboxylic Acid Acylating Agent

The carboxylic acid acylating agent utilized in the preparation of the two-cycle oil additive of the present invention may preferably be any monocarboxylic acid having at least 2 carbon atoms and generally less than 40, or aromatic monocarboxylic acids or acid-producing compounds thereof. Generally, the monocarboxylic acid suitable for carboxylic acid acylating agent used to prepare the dispersant will have a carbon range from 8 to 30 preferably from 16 to 20.

Aromatic and the heterocyclic monocarboxylic acids, as well as the aliphatic monocarboxylic acids, are suitable for use in the practice of the invention. Monocarboxylic acids containing substituent groups, are also suitable for use herein so long as they do not contribute to engines rusting or gel formation in finished oils. However, the preferred monocarboxylic acids reactants are the aliphatic monocarboxylic acids, i.e., the branched-chain saturated or branched or straight chain unsaturated monocarboxylic acids, and the acid halides and acid anhydrides thereof. Mixtures of branched and straight chain acids can also be used so long as the straight chain acid content is limited so as to not cause gel or sediment in finished oil, normally to less than 10% of the mixture. Particularly preferred are the aliphatic monocarboxylic acid reactants having a relatively long carbon chain length, such as a carbon chain length of between about 16 carbon atoms and about 30 carbon atoms. Non-limiting examples of the monocarboxylic acid reactant; acetic acid; acetic anhydride; acetyl fluoride; acetyl chloride; propionic acid; propiolic acid; propionic acid anhydride; propionyl bromide; butyric acid anhydride; isobutyric acid; crotonic acid chloride; crotonic acid anhydride; isocrotonic acid; β-ethylacrylic acid; valeric acid; acrylic acid anhydride; allylacetic acid; hexanoic acid; hexanoyl chloride; caproic acid anhydride; sorbic acid; nitrosobutyric acid; aminovaleric acid; aminohexanoic acid; heptanoic acid; heptanoic acid anhydride; 2-ethylhexanoic acid; decanoic acid; dodecanoic acid; undecylenic acid; oleic acid; heptadecanoic acid; stearic acid; isostearic acid; linoleic acid; linolenic acid; phenylstearic acid; xylylstearic acid; α-dodecyltetradecanoic acid; behenolic acid; cerotic acid; hexahydrobenzoyl bromide; furoic acid; thiophene carboxylic acid; picolinic acid; nicotinic acid; benzoic acid; benzoic acid anhydride; benzoyliodide; benzoyl chloride; toluic acid; xylic acid; toluic acid anhydride; cinnamic acid; cinnamic acid anhydride; aminocinnamic acid; salicylic acid; hydroxytoluic acid; naphthoyl chloride; and naphthoic acid.

Isostearic acid, a commercially available mixture of methyl branched $C_{18}$ carboxylic acid and containing minor amounts of other acids impurities, is the preferred monocarboxylic acid acylating agent. It is also preferred that the commercial isostearic acid not have a lactone content greater than 1.0 weight percent and that the straight chain content (GC area percent analysis) be less than 10 percent and preferably less than 8 percent. In addition, the non-$C_{18}$ acid content, which is comprised mainly of $C_{12}$, $C_{14}$ and $C_{16}$ acids is preferably less than 7 percent. A preferred isostearic acid is PRISORINE® 3502 available from Unichema International of 4650 South Racine Avenue, Chicago, Ill. 60609.

C - The High Molecular Weight Acylating agent

The high molecular weight acylating agent, if employed, may be comprised of at least one aliphatic or aromatic mono or dicarboxylic acid. High molecular weight as used herein defines a substituted acylating agent comprising number average molecular weights ($\bar{M}n$) which range from 700 to 4000 and preferably from 900 to 2500. The polymer molecular weight distribution (Mw/Mn) generally is less than 4.5:1, preferably less than 3:1 and more preferably 1.5:1 to 3:1. As previously indicated throughout this specification and claims, any reference to carboxylic acids as acylating agent is intended to include the acid-producing derivatives such as anhydrides, esters, acyl halides, and mixtures thereof unless otherwise specifically stated.

The acylating agent may contain polar substituents provided that the polar substituents are not present in portions sufficiently large to alter significantly the hydrocarbon character of the acylating agent exclusive of the carboxyl groups or cause excessive rusting when the finished additive is used in two-cycle oil. Typical suitable polar substituents include halo, such as chloro and bromo, oxo, oxy, formyl, sulfenyl, sulfinyl, thio, nitro, etc. Such polar substituents, if present, preferably do not exceed 10 percent by weight of the total weight of the hydrocarbon portion of the acylating agent.

Carboxylic acylating agents used to prepare the high molecular weight acylating agents are well known in the art and have been described in detail, for example, in U.S. Pat. Nos. 3,087,936; 3,163,603; 3,172,892; 3,219,666; 3,272,746; 3,306,907; 3,346,354; and 4,234,435. In the interest of brevity, these patents are incorporated herein for their disclosure of suitable mono- and polycarboxylic acid acylating agents which can be used as starting materials in the present invention.

As disclosed in the foregoing patents, there are several processes for preparing the high molecular weight acids used in this invention. Generally, the process involves the reaction of (1) an ethylenically unsaturated carboxylic acid, acid halide, or anhydride with (2) an ethylenically unsaturated hydrocarbon containing at least about 40 aliphatic carbon atoms. The ethylenically unsaturated hydrocarbon reactant can, of course, contain polar substituents, other oil-solubilizing pendant groups, and be unsaturated within the general limitations explained hereinabove. It is these hydrocarbon reactants which frequently, but not always, provide most of the aliphatic carbon atoms present in the acyl moieties of the final products.

When preparing the high molecular weight carboxylic acid acylating agent, the carboxylic acid reactant usually corresponds to the formula $R_o$-$(COOH)_n$, where $R_o$ can be alkyl but more frequently is characterized by the presence of at least one ethylenically unsaturated carbon-to-carbon covalent bond and n is an integer from 1 to 6 and preferably 1 or 2. The acidic reactant can also be the corresponding carboxylic acid halide, anhydride, ester, or other equivalent acylating agent and mixtures of one or more of these. Ordinarily, the total number of carbon atoms in the acidic reactant will not exceed 10 and generally will not exceed 4. Preferably the acidic reactant will have at least one ethylenic linkage in an alpha-beta position with respect to at least one carboxyl function. Exemplary acidic reactants are acrylic acid, methacrylic acid, maleic acid, maleic anhydride, succinic and succinic anhydride, fumaric acid, itaconic acid, itaconic anhydride, citraconic acid, citraconic anhydride, mesaconic acid, glutaconic acid, aconitic acid, crotonic acid, methylcrotonic acid, sorbic acid, 3-hexenoic acid, 10-decenoic acid, and the like.

As is apparent from the foregoing discussion, the high molecular weight acylating agents may contain cyclic and/or aromatic groups. However, the acids are essentially aliphatic in nature and in most instances, the preferred high molecular weight acid acylating agents are aliphatically substituted succinic acid or anhydride.

The aliphatic hydrocarbon-substituted succinic acid and anhydrides are especially preferred as acylating agents used as starting materials in the present invention. These succinic acid acylating agents are readily prepared by reacting maleic anhydride with a high molecular weight olefin or a chlorinated hydrocarbon such as a chlorinated polyolefin. The reaction involves merely heating the two reactants at a temperature of about 100°-300° C., preferably, 100°-200° C. The product from such a reaction is a substituted succinic anhydride where the substituent is derived from the olefin or chlorinated hydrocarbon as described in the above-cited patents. The product may be hydrogenated to remove all or a portion of any ethylenically unsaturated covalent linkages by standard hydrogenation procedures, if desired. The substituted succinic anhydrides may be hydrolyzed by treatment with water or steam to the corresponding acid and either the anhydride or the acid may be converted to the corresponding acid halide or ester by reacting with phosphorus halide, phenols, or alcohols.

The ethylenically unsaturated hydrocarbon reactant and the chlorinated hydrocarbon reactant used in the preparation of the high molecular weight acylating agents are principally the high molecular weight, substantially saturated petroleum fractions and substantially saturated olefin polymers. The polymers that are derived from mono-olefins having from 2 to about 30 carbon atoms are preferred. The especially useful polymers are the polymers of 1-mono-olefins such as ethylene, propene, 1-butene, isobutene, 1-hexene, 1-octene, 1-decene, 1-dodecene 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. These are exemplified by 2-butene, 3-pentene, and 4-octene.

The interpolymers of 1-mono-olefins such as illustrated above with each other and with other interpolymerizable olefinic substances such as aromatic olefins, cyclic olefins, and polyolefins, are also useful sources of the ethylenically unsaturated reactant. Such interpolymers include for example, those prepared by polymerizing isobutene with styrene, isobutene with butadiene, propene with isoprene, propene with isobutene, ethylene with piperylene, isobutene with p-methyl-styrene, 1-hexene with 1,3-hexadiene, 1-octene with 1-hexene, 1-heptene with 1-pentene, 3-methyl-1-butene with 1-octene, 3,3-dimethyl-1-pentene with 1-hexene, isobutene with styrene and piperylene, etc.

For reasons of hydrocarbon solubility, and stability the interpolymers contemplated for use in preparing the high molecular weight acylating agents of this invention should be substantially aliphatic and substantially saturated, that is, they should contain at least about 80 percent and preferably about 95 percent, on a weight basis, of units derived from aliphatic mono-olefins. Preferably, they will contain no more than about 5 percent olefinic linkages based on the total number of the carbon-to-carbon covalent linkages present.

The chlorinated hydrocarbons and ethylenically unsaturated hydrocarbons used in the preparation of the acylating agents can have molecular weight ($\overline{M}n$) of up to about 4000 or even higher. The preferred reactants are the above-described polyolefins and chlorinated polyolefins containing an average of at least 40 carbon atoms, preferably at least 60.

The high molecular weight acylating agents may also be prepared by halogenating a high molecular weight hydrocarbon such as the above-described olefin polymers to produce a polyhalogenated product, converting the polyhalogenated product to a polynitrile, and then hydrolyzing the polynitrile. They may be prepared by oxidation of a high molecular weight polydric alcohol with potassium permanganate, nitric acid, or a similar oxidizing agent. Another method for preparing such polycarboxylic acids involves the reaction of an olefin or a polar-substituted hydrocarbon with an unsaturated polycarboxylic acid such as 2-pentene-1,3,5-tricarboxylic acid prepared by dehydration of citric acid.

High molecular weight acylating agents may be obtained by oxidizing a monoalcohol with potassium permanganate or by reacting a halogenated high molecular weight olefin polymer with a ketene. Another convenient method for preparing monocarboxylic acid involves the reaction of metallic sodium with an acetoacetic ester or a malonic ester of an alkanol to form a sodium derivative of the ester and the subsequent reaction of the sodium derivative with a halogenated high molecular weight hydrocarbon such as brominated wax or brominated polyisobutene.

High molecular weight acid acylating agents can also be obtained by reacting chlorinated mono- and polycarboxylic acids, anhydrides, acyl halides, and the like with ethylenically unsaturated hydrocarbons or ethylenically unsaturated substituted hydrocarbons such as the polyolefins and substituted polyolefins described hereinbefore in the manner described in U.S. Pat. No. 3,340,281.

The high molecular weight monocarboxylic and polycarboxylic acid anhydrides are obtained by dehydrating the corresponding acids. Dehydration is readily accomplished by heating the acid to a temperature above about 70° C., preferably in the presence of a dehydration agent, e.g., acetic anhydride. Cyclic anhydrides are usually obtained from polycarboxylic acids having acid radicals separated by no more than three carbon atoms such as substituted succinic or glutaric acid, whereas linear anhydrides are obtained from polycarboxylic acids having the acid radicals separated by four or more carbon atoms.

The acid halides of the monocarboxylic and polycarboxylic acids can be prepared by the reaction of the acids or their anhydrides with a halogenating agent such as phosphorus tribromide, phosphorus pentachloride, or thionyl chloride.

Although it is preferred that the high molecular weight acylating agent is an aliphatic mono-or polycarboxylic acid, and more preferably a dicarboxylic acid, the substituted carboxylic acylating agent also may be prepared from aromatic mono- or polycarboxylic acid or acid-producing compound. The aromatic acids are principally mono- and dicarboxy-substituted benzene, naphthalene, anthracene, phenanthrene or like aromatic hydrocarbons. The substituted alkyl groups may contain up to about 300 carbon atoms. The aromatic acid may also contain other substituents such as hydroxy, lower alkoxy, etc. Specific examples of aromatic mono- and polycarboxylic acids and acid-producing compounds useful in preparing the high molecular weight acylating agent include benzoic acid, m-toluic acid, salicyclic acid, phthalic acid, isophthalic acid, terephthalic acid, 4-propoxybenzoic acid, 4-methyl-benzene-1,3-dicarboxylic acid, naphthalene-1,4-dicarboxylic acid, anthracene dicarboxylic acid, 3-dodecyl-benzene-1,4-dicarboxylic acid, 2,5-dibutylbenzene-1,4-dicarboxylic acid, etc. The anhydrides of thee dicarboxylic acids also are useful as the substituted carboxylic acylating agent.

It is essential to the present invention, however, that the monocarboxylic acid acylating agent and the high molecular weight carboxylic acylating agent when used, be selected to provide a total number of carbon atoms in the first and second acylating agents which is sufficient to render the dispersant hydrocarbon-soluble. In such instances, the sum of the carbon atoms in the two acylating agents will be at least about 40 carbon atoms and more generally will be at least about 175 carbon atoms. Accordingly, if the first carboxylic acylating agent contains a large number of carbon atoms, the second carboxylic acylating agent does not need to contain a large number of carbon atoms, and preferably is a lower molecular weight of mono-carboxylic acid such as isostearic acid.

Acylation of the polyalkylenepolyamine in the manner disclosed herein results in a variety of acylated polyalkylenepolyamine-containing molecular entities. As a result, the polyalkylenepolyamine molecules may not be all acylated with the monocarboxylic acid acylating agent or the high molecular weight acylating agent, when used, nor are all polyalkylene polyamine molecules acylated to the same extent. A distribution of acylated products is obtained in which the number of amine groups acylated on different amine-containing molecules ranges from zero in the extreme (no acylation) to acylation of all 1° and 2° amines (complete acylation).

Ideally, for the dispersant of this invention, the distribution of acylated products is maintained as narrow as possible. Preferably, all the amine groups should not be acylated (insufficient polarity for function as a dispersant). The other extreme i.e. low acylated molecules relative to the total amine content, will result in too high polarity for satisfactory oil solubility and dispersancy and would also provide a matrix for gel formation in the finished oil.

Generally, the equivalents or molar ratio of acylating agents to amine will be such that, on average, the dispersant molecules will have between 1 and 2 amine groups unreacted to provide polarity. The exact number depends on the ratio of the acylating agent(s) to each other and the specific composition of the polyalkylenepolyamine. A generally preferred molar ratio of acylating agent(s) for instance, to tetraethylene pentamine can range from 1:1 to 5:1 with a ratio of 3:1 to 4.5:1 being preferred. The ratio of the monocarboxylic acid acylating agent to high molecular weight acylating agent (when used) should be at least 3:1, more preferably from 5:1 to 59:1 and most desirably 5:1 to 12:1. The ratio of tertiary amine to total amine should be above about 0.6:1 preferably at least about 0.7:1 and most preferably at least 0.85:1.

The equivalent weight of the polyalkylenepolyamine for purposes of acylation is based on the number of primary and secondary amine groups per molecule, and the equivalent weight of these acylating agents is based on the number of carboxy groups per molecule. To illustrate, ethylene diamine has 2 equivalents per mole, and therefore, has an average equivalent weight of ½ its molecular weight and tetraethylene pentamine has 5 equivalents per mole and therefore, has an average equivalent weight of ⅕ of its molecular weight. The monocarboxylic acids have one carboxy group, and therefore the equivalent weight of the monocarboxylic acids is its molecular weight. The succinic and aromatic dicarboxylic acid acylating agents, on the other hand, have two carboxy groups per molecule, and therefore, the equivalent weight of each is one-half its molecular weight. Frequently, the equivalent weight of the polyalkylenepolyamine is determined by its nitrogen content, and the equivalent weight of acylating agents is determined by their acidity or potential acidity as measured by the neutralization or saponification equivalents.

However, many commercially available polyalkyleneamines have some tertiary nitrogen containing groups which will not acylate. For example, commercial tetraethylene pentamine contains about 10 percent alkyl substituted piperazine rings and probably has some tertiary amine groups formed by other branching reactions during the amine synthesis. Thus, the equivalent weight for purposes of acylation calculated from total nitrogen content will be higher that is actually the case.

Equivalent weights of polyalkyleneamines can also be calculated from total amine values measured by titration with hydrochloric acid or preferably perchloric acid. However, the same limitations described above are in effect in that tertiary amine groups will titrate but not acylate.

The dispersant reaction products of the invention are a complex molecule comprising oil soluble non-polar hydrocarbon containing moiety or moieties and polar unreacted amine containing moieties. For example, as discussed above for tetraethylene pentamine, the number of acylated amine groups varies in different molecules from 1 to as high as 5. The lower acylated portion of the molecules can form a matrix for gel in finished oils. The presence of dispersant components with a poor hydrophobic/hydrophylic balance i.e., too many amine groups relative to hydrocarbon chains. This can occur if the ratio of acid to amine is too low. It can also occur if the dispersant is not adequately vacuum stripped to convert amide/amine groups to imidazoline. This can be further exacerbated if too large a portion of the acylating groups are (1) of low molecular weight (2) are straight-chain (linear groups) and (3) contain undesirable pendant groups such as hydroxyl from lactone impurities in the monocarboxylic acid. Therefore, the tendency to gel formation can be reduced by increasing the average molecular weight of the combined acylating groups and increasing the ratio of acylating groups to available amine groups. However, either of the above can be detrimental if excessive. Increasing use of high molecular weight acylation agents beyond a reasonable amount would reduce the effectiveness of the dispersant in two-cycle oil. Also, increased use of both high and low molecular weight acylating agents again beyond a reasonable amount would also have a detrimental effect by disrupting the hydropholic/hydrophylic balance of the dispersant.

The broad range of acylating groups to amine stated above (molar or equivalent) should leave an average of from 0 percent to 50 wt. percent of the amine groups of the polyamine unreacted. It is preferred, however, to have from 20 to 40 percent of the amine groups that are titratable with hydrochloric acid before acylation still left unreacted after acylation. The most desirable amount left unreacted should be from about 30 to about 40 percent. As use herein, percent unreacted amine is determine by the American Oil Chemists Society (A.O.C.S.) Method Tf lb-64 incorporated herein by reference. The solvents are modified slightly to facilitate seeing the end points, i.e., 80 percent isopropyl alcohol/water is used for tetraethylenepentamine and 90/10 by volume isopropyl alcohol/toluene for the dispersants. The error band for this method is about ±3 percent.

The precise composition of the two-cycle oil dispersant additives of this invention are not known. The polar portion of the product, however, should be preferably comprised substantially of tertiary amines in heterocyclic rings wherein the ratio of tertiary amine to total amine is about preferably 0.7:1 (as measured by the AOCS method Tf lb-64) and more desirably, at least 0.85:1. The effectiveness of the additive in providing oil stability is dependant on the ratios of acylating agent(s) to amine and on the ratio of acylating agents to each other when both a monocarboxylic acid acylating agent and the high molecular weight acylating agent are used in preparing the dispersant. It is also dependent on the reaction conditions under which it is formed.

The temperature and pressure of the final stage of the reaction used to prepare the dispersant additives of this invention is critical to maximizing tertiary amine formation, and generally, reaction temperatures ranging from 120° C. up to the decomposition temperature of any of the reactants or the product and pressures of from 0.1 to 760 mm of Hg absolute can be utilized. Preferably, however, the temperature will be above about 150° C. and more generally from about 150° to about 240° C. The pressures used range generally from about 130 to 760 mm of Hg absolute. The higher the temperature the less need there is to reduce the pressure to eliminate water and form tertiary amines as heterocycles.

The preparation of the nitrogen-containing dispersant of the invention is conducted by reaction of the alkylene polyamine and carboxylic acylating agent and the optional high molecular weight acylating agent(s) preferably by adding the acid(s) to the amine in a "reverse addition" mode i.e. acylating agent(s) to amine.

The reaction is preferably conducted by the addition of the acid(s) to the amine in the "reverse addition" mode, however, the initial addition of the amine to a portion of the monocarboxylic acid acylating agent or a mixture of acylating agents followed by the subsequent addition of the remaining acid(s) or the separate addition of the acids, when applicable, in any order is also acceptable.

As indicated above, the optimum raw material addition sequence is to initially add all of the polyalkylenepolyamine. The order of addition of the monocarboxylic acylating agent and the optional acylating agent probably has no significant effect on the final product and they may be added simultaneously. However, the "reverse addition" of acid to amine may be impractical due to mixing limitations in a batch reactor. A modification of the preferred mode comprises initially charging some acid to the reactor. Generally, an amount ranging up to 50 percent by volume of the acid is charged to cover the impellers of the reactor. Preferably, the amount charge should be just sufficient to cover the impellers. Then the amine is charged followed by the remaining acids. The reactor temperature at the initial charge of acids can range from 80° C. to 150° C. and preferably from 110° to 130° C.

The reaction time is dependent upon the size of the charge and the reaction temperature. Generally, after the charging of all the acid to the reactor the reactor temperature is increased to from 140° C. to 160° C. and allowed to soak at reflux generally from about 2 to 4 hours.

It is important that some water be present in the system (produced by acylation) during reflux to maximize the acylation reaction. If water is stripped as produced, the amine/amide groups tend to form heterocycles too soon and this reduces the number of amine groups available for acylation by the acid. Low acid conversion results in an unsatisfactory product would result. Allowing water to remain directs the reaction towards maximizing acylation of the available amine/amide groups of the polyamine.

After reflux, the temperature is then increased to from about 170° C. to 190° C. for a period of time, generally from 3 to 10 hours during which most of the water formed during the acylation reaction is removed and a residual total acid number of below 10 is obtained. A small amount of water remains however, which limits cyclization of amide/amine groups. In the final stage, the reactor temperature is again increased, to further remove water including water eliminated by cyclization, to from about 195° C. to about 240° C. with inert gas purge. Alternatively, vacuum stripping may be used at about 150° to about 195° C. for the time required at a reduced pressure of from about 130 to about 250 mm Hg (absolute) with a inert gas bleed. Either method is directed to achieving a preferred tertiary amine to total amine ratio of about at least 0.7:1 or more preferably 0.85:1 to 0.95:1. It is desirous to have a free water level below about 0.2 wt. percent, preferably below 0.05 wt. percent in the final product.

Stripping is conducted as disclosed at a temperature and pressure preferably to maximize cyclization of remaining ethyleneamine groups with adjacent amide groups. The effect of this conversion to heterocycles containing tertiary amine groups may be measured by following the increase in the tertiary amine or the reduction in primary and secondary amines. With cyclization, the total titratable amine does not change, since only one of the nitrogen atoms in the heterocyclis rings is titratable with HCl. The ring structures or tertiary amine-containing groups are still polar and provide the hydrophilic moieties of the dispersant molecule.

It was discovered a stable product, one which substantially avoids gel formation is achieved by maximizing the conversion of the amine nitrogen to tertiary amines. The reaction process disclosed above is directed to ultimately decreasing the primary and secondary amine content and increasing the tertiary amine content of the reaction product to the ranges specified above.

II - Wax Crystal Modifier

The wax crystal modifiers used as additives of the invention comprise at least one mono or di-n-alkyl ester of a mono-ethylenically unsaturated $C_4$ to $C_8$ mono or dicarboxylic acid (or anhydride) in which the number of carbon atoms in the n-alkyl groups is 14. These unsaturated esters are preferably copolymerized with at least 10 percent (w/w) of an ethylene-unsaturated ester such as those described hereinafter, for example vinyl acetate.

The mono/dicarboxylic acid esters useful for preparing the polymer can be represented by the formula:

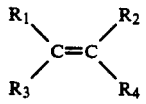

wherein $R_1$ and $R_2$ are hydrogen or a $C_1$ to $C_4$ alkyl group, e.g., methyl, $R_3$ is a $C_{14}$ CO.O or $C_{14}$ O.CO, where the chains are n-alkyl groups, and $R_4$ is hydrogen, $R_2$ or $R_3$.

The dicarboxylic acid mono or di-ester monomers is copolymerised with various amounts, e.g., 0 to 70 mole percent, of other unsaturated monomers such as esters. Such other esters include short chain alkyl esters having the formula:

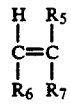

where $R_5$ is hydrogen or a $C_1$ to $C_4$ alkyl group, $R_6$ is

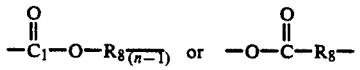

where $R_8$ is a $C_1$ to $C_5$ alkyl group branched or unbranched, and $R_7$ is $R_6$ or hydrogen. Examples of these short chain esters are methacrylates, acrylates, fumarates (and maleates) and vinyl esters. More specific, examples include methyl methacrylate, isopropenyl acrylate and isobutyl acrylate. The vinyl esters such as vinyl acetate and vinyl propionate being preferred.

Our preferred copolymers contain from 40 to 60 percent (mole/mole) of $C_{14}$ dialkyl fumarate and 60 to 40 percent (mole/mole) of vinyl acetate.

The ester polymers are generally prepared by polymerising the ester monomers in a solution of a hydrogen solvent such as heptane, benzene, cyclohexane, or white oil, at a temperature generally in the range of from 20° C. to 150° C. and usually promoted with a peroxide or azo type catalyst such as benzoyl peroxide or azodiisobutyronitrile under a blanket of an inert gas such as nitrogen or carbon dioxide in order to exclude oxygen. The polymer may be prepared under pressure in an autoclave or by refluxing.

The wax crystal modifier should be present in additive concentrates prepared using the additives of the invention at a level of from 0.2 to 5 percent by volume of the concentrate and preferably from 0.5 to 2 percent by volume of the concentrate. The dispersant can be present at a level of from 4 to 40 percent by volume and preferably from 10 to 18 percent by volume.

Treat rates for the additive concentrate of the invention can range from 5 to 60 percent by volume and preferably from 35 to 50 percent by volume.

Other additives may be added to the product of the invention claimed to impart other desirable properties thereto. For example, there may be added anti-oxidants, V.I. improvers, thickeners, thinners, anti-rusts, anti-wear agents.

The dispersants of the present invention can be incorporated into a lubricating oil in any convenient way. Thus, the compounds or mixtures thereof, can be added directly to the oil by dissolving the same in the oil at the desired level or concentrations for the dispersant. Alternatively, the dispersant can be blended with a suitable oil soluble solvent such as mineral spirits and/or base oil to form a concentrate and then the concentrate may be blended with lubricating oil to obtain the final formulation. Such dispersant concentrates will typically contain (on an active ingredient (A.I.) basis) from about 30 to about 100 wt. percent, and preferably from about 50 to about 80 wt. percent of the additive. The concentrate can also comprise from 0–80 wt. percent, typically from 10 to 60 weight percent solvent.

The invention is more fully delineated in the following Examples.

EXAMPLE 1

A sample of acylated amine dispersant suitable for two-cycle oils was prepared in a pilot reactor from isostearic acid having a total acid number of about 190 mg KOH/g and containing less than 1.0 percent lactone. The dispersant was vacuum stripped at 20 mm of Hg gauge and 170° C. for three hours as a final step in the synthesis to reduce gel forming tendency by converting some amide/amine groups to imidazoline. The dispersant had a Total Amine Value of 63 and a Tertiary Amine Value of 52 mg KOH/g, giving a Tertiary/Total Amine Value of 0.8:1. However, this dispersant still formed gel in two-cycle oils stored in the cold for extended periods.

This dispersant, blended to 10 wt. percent in 4 cSt/100° C. Polyalphaolefin Synlube was treated with a $C_{14}$ alkyl side-chain WCM (0.3 vol. percent; 88 percent AI). This sample and a control which had not been treated were subjected to cold storage outside during the winter at −20° to +5° C. and in a refrigerator at 0° to +5° C. during warmer weather. After 173 days, floc and gel were identified in the untreated sample. The treated sample was still bright and clear when checked after 335 days. This indicates that for this dispersant crystallization of the linear components into gel precursors was controlled by the WCM.

EXAMPLE 2

A wax free blend of an isostearic acid/tetraethylenepentamine/polyisobutylene succinic anhydride (ISA/TEPA/PIBSA) dispersant at 10 wt. percent in 4cSt/100° C. polyalphaolefin was prepared in accordance with the method described herein. The blend was divided, and, to one of the parts, was added a vinyl acetate/alkylfumarate (WCM) prepared with a $C_{14}$ carbon alcohol (to esterify the fumaric acid) at a treat rate of 0.3 vol. percent. The two oil blends were stored outside in during cold weather (−20° C. to +5° C.) and in a refrigerator during warm weather (0° to 5° C.) starting. After 173 days, floc and gel were identified in the untreated portion of the blend. The portion containing the wax crystal modifier was clear and bright when observed after 335 days.

The ISA-PIBSA-TEPA additive was adequately vacuum stripped during its synthesis (tertiary: total amine ratio of 0.88). Thus, it was satisfactory in terms of hydrophylic/hydrophobic balance.

What is claimed is:

1. A two-cycle oil additive comprising a nitrogen-containing dispersant (I) which is the reaction product of (A) at least one polyalkylene polyamine (B) at least one monocarboxylic acid acylating agent and optionally (C) at least one high molecular weight carboxylic acid acylating agent; and (II) a wax crystal modifier which is co-polymer of (A) a mono or di-n-alkyl ester of a monoethylenically unsaturated $C_4$ to $C_8$ mono or dicarboxylic acid or anhydride wherein the number of carbon atoms in the n-alkyl groups is 14 and (B) at least one other unsaturated monomer.

2. The two-cycle oil additive of claim 1, wherein the dispersant has tertiary amine to total amine ratio is above about 0.6:1.

3. The two-cycle oil additive of claim 2, wherein the tertiary amine to total amine ratio is at least 0.85:1.

4. The two-cycle oil additive of claim 1, wherein the dispersant has a molar ratio of monocarboxylic acid to high molecular weight acylating agent of at least 3:1.

5. The two-cycle oil additive of claim 4, wherein the molar ratio of monocarboxylic acid to high molecular weight acylating agent ranges from 5:1 to 59:1.

6. The two-cycle oil additive of claim 5, wherein the molar ratio of monocarboxylic acids acylating agent to high molecular weight acylating agent ranges from about 5:1 to 12:1.

7. The two-cycle oil additive of claim 1, wherein the ratio of acylating agent(s) to polyalkylene amine is from 3.5:1 to 4.5:1.

8. The two-cycle oil additive of claim 1, wherein the high molecular weight acylating agent has a number average molecular weight of from 700 to 4,000.

9. The two-cycle oil additive of claim 8, wherein the high molecular weight acylating agent is polyisobutylene succinic acid or anhydride.

10. The two-cycle oil additive of claim 1, wherein the monocarboxylic acid acylating agent is isostearic acid.

11. The two-cycle oil additive of claim 1, wherein the polyalkylenepolyamine has the formula:

$$H_2N(\underset{\substack{|\\ R^1}}{R}NH)_nH$$

wherein R is a $C_2$ to $C_3$ alkylene radical, $R^1$ can be hydrogen or an alkyl radical of from about 1 to about 16 carbon atoms and n is an integer of one or greater.

12. The two-cycle oil additive of claim 11, wherein the polyamine is tetraethylene pentamine.

13. The two-cycle oil additive of claim 1, wherein the wax crystal modifier is a $C_{14}$ dialkyl fumarate/vinyl acetate copolymer.

14. The two-cycle oil additive of claim 13, wherein the wax crystal modifier contains from 40 to 60 percent (mole/mole) of $C_{14}$ dialkyl fumarate and 60 to 40 percent (mole/mole) of vinyl acetate.

15. A two-cycle oil composition comprising an oil of lubricating viscosity and from 5 to 60 percent by volume of a nitrogen-containing dispersant which comprises a dispersant (I) which is the reaction product of (A) at least one polyalkylene polyamine (B) at least one monocarboxylic acid acylating agent and optionally (C) at least one high molecular weight carboxylic acid acylating agent; and (II) a wax crystal modifier which is co-polymer of an esterified mono or dicarboxylic acid and at least one other unsaturated monomer and wherein the mono or dicarboxylic acid is esterified with $C_{14}$ alkyl.

16. The two-cycle oil composition of claim 15, wherein the dispersant is a reaction product of isostearic acid and tetraethylenepentamine and optionally a polyisobutylene succinic anhydride.

17. The two-cycle oil composition of claim 16, wherein the dispersant has a tertiary amine to total amine to ratio of above about 0.6:1.

18. The two-cycle oil composition of claim 17, wherein the tertiary amine to total amine ratio is at least 0.85:1.

19. The two-cycle oil composition of claim 16, wherein the ratio of isostearic acid to polyisobutylene succinic anhydride is at least 3:1.

20. The two-cycle oil composition of claim 19, wherein the ratio of isostearic acid to polyisobutylene succinic anhydride ranges from about 5:1 to 12:1.

21. The two-cycle oil composition of claim 15, wherein the wax crystal modifier is a $C_{14}$ dialkyl fumarate/vinyl acetate copolymer.

22. A two-cycle oil concentrate comprising from 3 to 25 percent by volume of a dispersant (I) which is the reaction product of (A) at least one polyalkylene polyamine (B) at least one monocarboxylic acid acylating agent and optionally (C) at least one high molecular weight carboxylic acid acylating agent; and from 0.2 to 5 percent by volume of (II) a wax crystal modifier which is co-polymer of (A) a mono or di-n-alkyl ester of a monoethylenically unsaturated $C_4$ to $C_8$ mono or di-carboxylic acid or anhydride wherein the number of carbon atoms in the n-alkyl groups is 14 and (B) at least one other unsaturated monomer.

* * * * *